United States Patent [19]

Freissmuth et al.

[11] 4,169,724

[45] Oct. 2, 1979

[54] DESULFURIZATION OF IRON MELTS

[75] Inventors: Alfred Freissmuth, Trostberg; Werner Gmoehling, Hufschlag; Heinrich Roeck; Peter Kniep, both of Trostberg, all of Fed. Rep. of Germany

[73] Assignee: SKW Trostberg Aktiengesellschaft, Trostberg, Fed. Rep. of Germany

[21] Appl. No.: 881,351

[22] Filed: Mar. 8, 1978

[30] Foreign Application Priority Data

Feb. 26, 1977 [DE] Fed. Rep. of Germany ..... 2708522

[51] Int. Cl.[2] ..... C21C 7/02

[52] U.S. Cl. ..... 75/58; 75/53; 75/130 BB

[58] Field of Search ..... 75/53, 58, 130 BB

[56] References Cited

U.S. PATENT DOCUMENTS

| | | | |
|---|---|---|---|
| 3,876,421 | 4/1975 | Takemura | 75/58 |
| 3,885,957 | 5/1975 | Richter | 75/58 |
| 3,929,464 | 12/1975 | Todd | 75/58 |
| 3,998,625 | 12/1976 | Koros | 75/53 |
| 4,036,635 | 7/1977 | Klapdar | 75/58 |
| 4,040,818 | 8/1977 | Clegg | 75/53 |

*Primary Examiner*—P. D. Rosenberg

*Attorney, Agent, or Firm*—Curtis, Morris & Safford

[57] ABSTRACT

Desulfurization of iron melts with alkaline earth metal containing carbidic or metallic materials by introducing the desulfurizing agents in a finely divided form with a consumable gas causing an exothermic reaction in an iron melt.

7 Claims, No Drawings

DESULFURIZATION OF IRON MELTS

Desulfurization of pig iron and steel has taken on increasing importance because ores of lower quality and increasingly higher sulfur containing coke or heating oil are used. Only as a result of desulfurization of the molten iron, after pig iron production and before steel production, or after crude steel production (also known as steel desulfurization), can steel be obtained of the desirable and increasingly low sulfur content and of low inclusion content.

As a result of novel treatment of molten pig iron or molten steel with calcium or magnesium containing compounds, iron or steel can be obtained with the desired low sulfur and/or oxygen content. As calcium containing desulfurization and/or deoxidation agents, compounds or compositions of calcium carbide and calcium silicon ($CaSi_2$) are especially useful. An advantageous method described herein allows these agents to be brought into the molten iron in contact therewith. This method comprises the employment of high pressure gases as the suitable blast gases for introducing into contact with molten iron fine particulate powders of these materials in conjunction with and with the help of a carrier gas. As carrier gas, dried air, nitrogen, argon, or mixtures thereof previously been mentioned.

Calcium carbide and calcium silicon dissolved in the melt with the dissociation of calcium which then associates with oxygen or sulfur dissolved in iron. At the lower temperature of molten pig iron and its higher saturation degree with carbon, calcium carbide reacts in solid phase with liquid iron and binds sulfur, in molten iron, forming calcium sulfide. Calcium oxide formed from the above-named agents or contained therewith also acts as a desulfurizer because it too will be converted to calcium sulfide.

For the effectiveness of the fine particulate desulfurization agent it is important to maintain the desulfurization agent in contact with the iron melt for as long a period as possible in as intimate a contact as possible. The herein named alkaline earth metal containing materials, that is, compounds and alloys will be designated as alkaline earth materials. These materials not only act as desulfurizers, but also as deoxidizers.

Of the alkaline earth materials, the calcium containing alkaline earth materials have beneficial effects associated with the inclusions remaining in steel in the form and amounts thereof. However, even though for simplification, in the following, desulfurization is mentioned, it must be understood that the desoxidation (deoxidation) and the inclusion modification must be also taken into consideration as additional benefits obtainable when practicing the present invention.

The introduction of the cold alkaline earth materials with a cold blast gas in the iron melt, which is at a temperature of 1200° to 1750° C., causes a temperature drop which is undesirable especially with respect to molten steel. Various after treatments of steel in a ladle, as a result of the small permissible margin for temperature variations, render a temperature drop in the steel highly undesirable. It also restricts, because of solidification, the various after treatments.

As a result of the invention, the alkaline earth materials, as agents, which achieve a desulfurization and/or desoxidation are employable in such a manner that in the iron melt, during the reaction, these agents undergo an exothermic reaction heating the molten iron, and the temperature depression of the molten iron, associated with the entire process, is thereby reduced.

As a consequence, the temperature range for useful treatments of steel in a ladle is considerably expanded. The selection of the alkaline earth materials and the blast gas must also be such that, at the temperature of the iron melt, an exothermic reaction between the gas and the alkaline earth metal agents can take place.

As a further advantage, the more expensive noble argon gas, commonly used in steel desulfurization according to today's practice, is replaced with less expensive gases and/or amounts thereof reduced.

As a further advantage of the present invention, the bubbling of slag at the surface of the molten material is avoided and the surface of the melt is held fairly quiescent. Accordingly, these two conditions prevent the loss of heat from the melt surface.

The described desulfurization and/or desoxidation of the molten iron is achieved by the use of consumable gases at the temperature of 1200° to 1750° C. These gases are being introduced with the carbidic and/or metallic alkaline earth materials in such a way that the introduced gases react with these compounds exothermically and are fully consumed. As useful consumable gases to achieve these reactions, carbon dioxide and carbon monoxide are suitable. Oxygen is also useful for the injection technique. From the standpoint of safety, carbon dioxide is preferred.

Cost-wise, carbon dioxide is readily available in a fairly pure form, it is easy to use, and it is easy to handle. It is non-poisonous and non-combustible. Carbon dioxide is greatly used at temperatures under 500° C. as an inert or protective gas, which, in connection with the handling and transportation of calcium carbide, has advantageous significance.

Further, in connection with the description of this invention, carbon dioxide will be described as the carrier gas. However, it is to be understood that the invention is not to be confined to that gas, but is to be considered from all of the disclosures herein. Reactions with carbon monoxide are similar, but flammability and poisonous characters of carbon monoxide, while not insurmountable, are recognized.

It must be noted, however, that one aspect of the invention is that the blast gas or carrier gas, i.e., the gas with which the alkaline earth material reacts exothermically, is thereby consumed. These blast gases or carrier gases with which the desulphurization agent is introduced in the melt as fine, turbulent bubbles, as a result of the reaction, are fully consumed and collapse. The collapse of the gas bubbles also causes an intensive mixing of the iron melt. The injected blast (consumable) gas disappears as a result of the exothermic reaction, however, the superheated alkaline earth metal carrier, as a result of the blast, is introduced into the iron melt. The desulfurization and deoxidation then takes place in the iron melt.

Carbon dioxide and carbon monoxide react with excess calcium carbide in the blast gas according to the following two equations:

$$2CaC_2 + CO_2 \cdot 2CaO + 5C \quad \Delta H = -181 \text{ kcal/Mol} \tag{1}$$

$$CaC_2 + CO \cdot CaO + 3C \quad \Delta H = -111 \text{ kcal/Mol} \tag{2}$$

These reactions produce considerable amounts of heat as indicated above.

With excess calcium silicon, the carbon dioxide reacts according to equation:

$$2CaSi_2+CO_2 \rightarrow 2CaO+C+4Si \quad \Delta H=-209 \text{ kcal/Mol} \quad (3)$$

If the silicon in calcium silicon reacts with the blast gas, the following equation obtains:

$$2CaSi_2+5CO_2 \rightarrow 2CaO+4SiO_2+5C \quad \Delta H=-701 \text{ kcal/Mol} \quad (4)$$

This holds true, however, only for temperatures under 1550° C. and when desulfurizing pig iron. Above this temperature carbon monoxide is more stable than silicon dioxide.

With excess magnesium, acting as another alkaline earth metal desulfurizer, the corresponding reactions are as follows:

$$2Mg+CO_2 \rightarrow 2MgO+C \quad \Delta H=-193 \text{ kcal/Mol} \quad (5)$$

$$Mg+CO \rightarrow MgO+C \quad \Delta H=-117 \text{ kcal/Mol} \quad (6)$$

Likewise, a considerable amount of heat is set free thereby.

The amount of the released heat is determined in accordance with the introduction of insufficient blast gas such as carbon dioxide, carbon monoxide, or oxygen. It is easily controlled by the weight percent of the desulfurizing agent used in the blast gas being introduced.

The foregoing described an essential advantage of the process in accordance with the invention. It should be understood that in the blast gas, the partially combusted alkali earth materials such as calcium carbide, calcium silicon, calcium and magnesium are always in an excess amount.

In a further aspect and advantage of the present process, as a result of the desulfurizing action through the exothermic reaction of the alkaline earth metal carriers with the blast gas, reaction products are formed in situ in the injected gas. These reaction products are very finely divided, highly active alkaline earth metal oxides. For example, in the desulfurization of pig iron conventionally done with 10 N liters of blast gas (normal liters, i.e., at standard temperature and pressure), about 1 kilogram of desulfurizing agent is introduced. However, when according to the invention, the same amount of gas is employed using a blast gas of carbon dioxide, then it is sufficient thereby to oxidize about 57 grams of calcium carbide, 22 grams magnesium, or 36 grams of calcium, respectively; correspondingly, about 81, 87 or 94 kcal per mole are liberated.

These amounts correspond to only a fraction of the introduced alkaline earth material mass. The rest of the material, which is carried in the consumed and collapsing gas bubbles, reaches the melt unchanged, but considerably superheated, and causes the desulfurization therein in conjunction with the newly formed oxides (formed under the exothermic reaction conditions).

If it is advantageous, not only can the pure alkaline earth metal containing materials be used, but all types of different compositions or mixtures of the alkaline earth metal compounds or alloys mentioned herein.

In addition, especially for the treatment of molten steel, the addition of aluminum is beneficial for these purposes. Finally, it is mentioned as advantageous that metallic or carbidic alkaline earth metal containing compositions can have, as diluents added thereto, alkali earth carbonates or oxides as well as other materials added which affect the composition and consistency of the obtained slags.

The desulfurization causing elements, compounds, alloys or mixtures, should be finely divided. The particulate size should be under 0.5 milimeter, preferrably under 0.1 millimeter.

With the aid of today's conventional injection technology, the fine particulate alkaline earth materials are introduced by the blast gas at appropriate locations in the blast furnaces, open hearth furnaces, ladles of various types, or in the iron melts found in mixing vessels.

It has been found especially advantageous when the alkaline earth material is introduced in the iron melt via a (injection) lance, preferably deep in the iron melt. The static pressure due to the iron melt or at the appropriately introduced gas excess pressure, causes the reaction to proceed that much better between the carbon dioxide and the alkali earth material.

The invention is further illustrated by the examples herein which are merely to show various embodiments of the invention without an intent to delimit the described invention thereby.

EXAMPLE 1

A total of 306 kilograms of fine particulate calcium carbide with a particulate size of less than 0.3 millimeters was introduced into a pouring ladle containing 124 tons of liquid steel at a temperature of 1635° C. Instead of the previously employed conventional argon gas introduction devices, a carbon dioxide containing vessel and an introduction means therefor were connected to an appropriate particulate material dispenser.

Accordingly, 18 liters (normal) of carbon dioxide per kilogram of the introduced carbide powder were used. A lance employed for that purpose reached a depth of 1.85 meters in the ladle. At the surface of the molten steel, during introduction of the blast, only a slight circulating motion could be observed without any observation on the melt surface of breaking bubbles, freed and burning gases and any strong flames caused by the burning alkaline earth metals. Had argon been used for the blast, it would cause the temperature to be lowered by about 32° C. on the average, however, the temperature of the steel was lowered only about 19° C. on the average. The sulfur content was lowered from a starting value of about 0.023 percent to 0.002 percent. The average value for the desulfurization degree (expressed as $\eta_s=\Delta S/S_A$ where $\Delta S$ is the reduction of the sulfur content and $S_A$ as the starting sulfur content) was 0.93 obtained from eight of the previously described treatments of steel. This is considerably better desulfurization which, under identical conditions, is obtained when using argon as the carrier gas therefor. In addition, the amount of the desulfurizing agent used was only 85 percent of that needed when using argon as a carrier gas.

EXAMPLE 2

A predesulfurized pig iron in a carrier ladle was drastically desulfurized with a mixture of magnesium powder, finely divided, burnt lime and fluorspar ($CaF_2$) in proportions of 15 percent magnesium, 80 percent calcium oxide, and 5 percent $CaF_2$.

For this example, the injection gas apparatus used was interconnected with carbide dioxide batteries instead of the conventionally used argon-carrier gas supply. In a ladle which contained about 86 tons of pig iron, at a temperature of 1315° C., were injected 282 kilograms of the previously defined desulfurizing mixture. The gas lance through which the gas was introduced, was inserted as deeply as possible in the ladle. The depth reached thereby was about 1.95 meters. Under these conditions, no bursting bubbles were observed at the melt surface normally associated with a very bright light encountered conventionally when magnesium introduction takes place. At the same insertion depth and use of argon as the conventionally employed gas, a considerable amount of magnesium vapor reached the bath surface and burned thereat with a lively flame. The mixture was introduced using 22 normal liters of carbon dioxide as carrier gas per kilogram of the desulfurizing agent.

During the desulfurization, the temperature which conventionally would be lowered by about 30° C. was only lowered to about 15° C. The pig iron was furnished with a starting value of 0.018 percent sulfur. After the above described treatment, the sulfur content was found to be only 0.001 percent. This corresponds to a desulfurization degree of $\eta_s=0.94$. This value was obtained in a series of 12 different treatments with great consistency. When argon was used as blast gas under identical conditions, the same desulfurization could only be achieved when employing more than 20 percent of the same desulfurizing agent.

What is claimed is:

1. In a process for desulfurization or desoxidation or conjoint desulfurization and desoxidation of an iron melt at a temperature from 1200° up to 1750° C. by injecting with a gas carbidic or metallic alkaline earth containing materials or mixtures thereof, the improvement comprising introducing, into an iron melt, a carbide of an alkaline earth metal, alkaline earth metal containing material or mixtures thereof, in a finely divided form with a gas selected from the group consisting of carbon dioxide, carbon monoxide, and mixtures thereof, reacting exothermically said carbide or said alkaline earth metal material or mixtures thereof in said melt, with said gas, and substantially consuming said gas by said reaction with said carbide or alkaline earth material.

2. The process as defined in claim 1 and wherein the gas is consumed within the melt.

3. The process as defined in claim 1 and wherein the alkaline earth material is calcium carbide; calcium silicon; mixtues of calcium carbide and calcium silicon; calcium; magnesium; mixtures of magnesium, calcium and calcium carbide; and mixtures of magnesium and calcium.

4. The process as defined in claim 1 and wherein, as alkaline earth materials, a fine particulate is used with a particulate size of less than 0.5 millimeters.

5. The process as defined in claim 1 and wherein the alkaline earth material compositions are alloys of calcium or alloys of magnesium, or said alloys with aluminum or silicon or mixtures thereof.

6. The process as defined in claim 1 and wherein the gas is introduced in an amount from 3 normal liters up to 500 normal liters per kilogram of the alkaline earth material used.

7. The process as defined in claim 1 and wherein said gas and said carbide of an alkaline earth metal, alkaline earth material, or mixtures thereof are injected into said melt via a lance.

* * * * *